US006584821B1

(12) United States Patent
Ghiran et al.

(10) Patent No.: US 6,584,821 B1
(45) Date of Patent: Jul. 1, 2003

(54) SELF-ALIGNING NON-PINCHING HYDROFORMING DIES

(75) Inventors: Mircea M Ghiran, Lake Orion, MI (US); Spyros Pete Mellas, Waterford, MI (US); Paul C Oberski, Roseville, MI (US)

(73) Assignee: General Motors Company, Detroit, MI (US)

( * ) Notice: Subject to any disclaimer, the term of this patent is extended or adjusted under 35 U.S.C. 154(b) by 0 days.

(21) Appl. No.: 10/123,662

(22) Filed: Apr. 16, 2002

(51) Int. Cl.[7] ..... B21D 26/02; B21D 15/10

(52) U.S. Cl. ..... 72/58; 72/57; 72/61; 72/370.06; 29/421.1

(58) Field of Search ..... 72/57, 58, 61, 72/370.06, 370.22; 29/421.1

(56) References Cited

U.S. PATENT DOCUMENTS

| | | | | | |
|---|---|---|---|---|---|
| 468,272 | A | | 2/1892 | Watt | |
| 1,666,844 | A | | 4/1928 | Centeno | |
| 2,639,754 | A | * | 5/1953 | Macy | 72/58 |
| 3,154,978 | A | * | 11/1964 | Baker | 72/416 |
| 3,251,216 | A | | 5/1966 | Broske | 72/416 |
| 3,417,598 | A | * | 12/1968 | Valente | 72/383 |
| 4,283,933 | A | | 8/1981 | Wiener | 72/409 |
| 4,599,921 | A | | 7/1986 | Gaither et al. | 82/1 C |
| 5,007,267 | A | * | 4/1991 | Washizu et al. | 72/59 |
| 5,233,854 | A | | 8/1993 | Bowman et al. | 72/58 |
| 5,233,856 | A | | 8/1993 | Shimanovski et al. | 72/62 |
| 5,339,667 | A | * | 8/1994 | Shah et al. | 72/58 |
| 5,987,950 | A | * | 11/1999 | Horton | 72/58 |
| 6,134,931 | A | * | 10/2000 | Glaesener | 72/58 |
| 6,387,117 | B1 | * | 5/2002 | Arnold et al. | 72/416 |

* cited by examiner

*Primary Examiner*—David Jones
(74) *Attorney, Agent, or Firm*—Charles E. Leahy

(57) ABSTRACT

A pair of self-aligning non-pinching hydroforming dies have fingers and slots which are operable during closure of the dies on a tubular part to effect precise alignment of the dies as they are pressed together to form a hydroforming cavity about the part so that the part is not pinched between mating surfaces of the dies during their closure on the part. The fingers are further capable of mechanically straightening and/or bending the part, if need be, to prevent pinching of the part during die closure. The fingers are also capable of mechanically forming a round tubular part to a non-round cross-section region of the die cavity as the dies close to help form the part as well as prevent pinching of this section. With all such mechanical forming operations by the action of the fingers on the part performed prior to the hydroforming of the part in the die cavity.

6 Claims, 5 Drawing Sheets

SELF-ALIGNING NON-PINCHING HYDROFORMING DIES

TECHNICAL FIELD

This invention relates to hydroforming dies and more particularly to hydroforming dies that provide for mechanically forming as well as hydroforming parts.

BACKGROUND OF THE INVENTION

With the hydroforming dies and associated positioning apparatus commonly used to hydroform tubular metal parts to a large variety of different shapes, certain difficulties prone to produce scrap parts can arise in the hydroforming process. And typically result from the particular hydroforming die cavity configuration formed by the dies and/or the shape of the part as received by the dies. For example, very precise repeatable alignment of the dies during their closure on the part may be required to avoid having to scrap unacceptable misshaped parts following hydroforming such as can result when the part as received by the dies has a substantial interference configuration with respect to the die surface on either one or both of the dies as they close on the part.

Another difficulty apart from inaccurate die alignment that can arise resulting in scraped parts following their hydroforming is pinching of the part between the dies during die closure. And again because of the particular die cavity configuration and/or the shape of the part as received by the dies. Such instances have been found to mostly occur where the die cavity configuration will not accept, without forced engagement, a tubular part that is bent to a considerable degree and/or has a cross-sectional dimension considerably larger than that of the die cavity.

Relating these findings to prior known hydroforming dies and attendant apparatus such as disclosed in U.S Pat. Nos. 5,233,854 and 5,233,856 assigned to the assignee of this invention, such problems do not typically arise unless the particular die cavity configuration and/or the shape of the part as received by the dies forces these issues as mentioned above. In the latter event, there are various approaches to avoiding these problems. For example, the hydroforming dies may be guided into alignment, in a manner like steel stamping dies, by pins on one of the dies that are received in bushings on the other die. In that case, very close tolerances can be imposed with respect to the relative pin and bushing locations on the dies. And the tolerances between the pins and bushings can be reduced to a very close slip fit in the quest for accurate die alignment. But this still may not solve the problem because the peripheries of the die cavity surfaces on the dies are not a close enough match. In that case, a demand is also placed on forming the hydroforming die surfaces so that their peripheries are made to match as closely as possible with the best state-of-the-art die cutting machinery and tools.

Apart from die alignment and die cavity surface periphery matching, a pinching problem can still remain because of shape of the part as received by the dies. For example, the part may be bent as a result of improper handling or having been cut to the desired length from bent tubular stock as received from the tube stock manufacturer and/or it may have a cross-sectional shape or profile considerably larger than that of the die cavity. Two possible solutions are known to have been proposed to solving such problems and these are (1) prefilling the part with the hydroforming fluid at a certain pressure prior to closing the dies on the part, and (2) mechanically preforming the part to a certain degree in a set of preforming press dies. In the latter instance, the part is preformed so as to compensate for an otherwise unaccommodating region(s) of the hydroforming die cavity surfaces as the dies are pressed together about the part. However, these approaches to preventing pinching involve significant added costs. Moreover, while such approaches have proven generally satisfactory, there can still remain significant problems with certain die cavity configurations. And particularly with respect to pinching where even small dimensional deviations in the part (either preformed, filled or not preformed) can result in repeated die tryouts, scraped parts and subsequent die and/or part modifications before a satisfactory solution is found.

In the present invention, certain features are incorporated in the hydroforming dies that provide for precise die alignment and according to need, also provide for mechanical straightening and/or bending of the tubular part to be hydroformed and also mechanical reshaping of the cross-section of the part. With all such operations on the tubular part being performed by the hydroforming dies as they close on the part to effect precise repeatable die alignment and prevent pinching of the part prior to hydroforming the part in the dies.

In that certain features of the hydroforming dies of the present invention might standing alone be considered in a broad sense as jaw-like devices and considering the background of such devices, there are of course many various prior known devices of this general type using various forms of jaws or the like. But in form and function, they are quite different from the present invention as will be seen from both the summary and detailed description of invention that appears later herein. Examples of such prior jaw-like devices are disclosed in U.S. Pat. No. 468,272, which relates to a box clamp, U.S. Pat. No. 1,666,844, which relates to a nail straightening device, U.S. Pat. No. 3,251,216, which relates to an electrical connector applier, U.S. Pat. No. 4,283,933, which relates to a pair of pliers, and U.S. Pat. No. 4,599,921, which relates to a drill holder. These devices all grip or clamp a part but neither release the part for continued processing of the part in the device nor are they intended to or readily adaptable to doing so in a release mode.

SUMMARY OF THE INVENTION

The present invention diverges from previous known approaches to solving the above mentioned hydroforming die alignment and pinching problems by tackling these problems directly in design of the hydroforming dies rather than with attendant die alignment apparatus, reshaping the cross-section of the part in a preforming operation and/or prefilling the part prior to insertion of the part in the dies. This is accomplished with a significantly improved hydroforming die design that produces in a very cost-effective manner very precise and repeatable die alignment while positively preventing pinching of the part. And therefore eliminates or at least significantly diminishes the need for repeated die tryouts and the number of scrapped parts which is especially significant in a high volume production run of critical and costly parts; for example, the hydroforming of motor vehicle parts such as motor vehicle frame parts.

In the present invention, the dies for hydroforming a part are provided with die cavity forming surfaces on their inner side which cooperatively form a desired die cavity about a tubular part to be processed and also partially mechanically shape the part when the dies are pressed together in precise alignment. And wherein the die cavity thus formed has, as is conventional, openings open to the ends of the part for the supply of hydroforming fluid to the interior of the part and eventually the exhaust thereof. Such precise die alignment is provided by fingers on the inner side of each of the dies that are closely received in and guided by slots in the inner side of the other die as the dies are brought together. And wherein the fingers and slots on the inner side of each die are arranged in rows on opposite sides of and along the periphery of their respective die cavity forming surface and extend transverse to their respective die cavity surface periphery.

The die fingers are separated by the slots in each row and are staggered with respect to those in the other row on the respective die. In addition, the fingers have a flat tubular part engaging edge surface and the edge surfaces of the fingers in the two rows on each of the dies face oppositely and extend at an angle to their respective die cavity forming surface. The edge surfaces of the fingers in the two rows on each of the dies form an acute angle there-between such that as the dies are pressed together about a tubular part positioned between the fingers on the dies, these edge surfaces of the fingers cooperate to produce a funneling wedging scissoring action on opposite sides of the tubular part forcing the tubular part toward the die cavity surfaces while smoothly gradually mechanically forming the tubular part, as need be, to the die cavity surfaces to prevent pinching of the part between the dies as the dies are finally pressed together at their mating surfaces to form the die cavity about the part.

The die fingers and slots of the present invention thus eliminate any need for prefilling or preforming the cross-section of the part to prevent pinching as well as provide precise die alignment without added guide pins and bushings. Moreover, the die fingers and slots, which thus provide the dies with self-alignment, can be utilized to mechanically form desired bends in the part as well as provide mechanical straightening and/or substantial reshaping of the cross-section of the part prior to hydroforming.

The ability of the hydroforming dies of the present invention to perform mechanical forming of a part prior to hydroforming the part is very advantageous from both cost and manufacturing standpoints as it can eliminate the need for costly one-of-a-kind preforming press dies and the accompanying additional processing steps and/or having to prefill the part in a preliminary step. And there are, of course, limits to this ability from a mechanical metal working standpoint in order to prevent splitting or cracking of the part. But moreover, it has been found that there is also a practical limit with respect to preventing pinching of the part between hydroforming dies where the part is also being mechanically formed by the hydroforming dies as in the present invention. And in particular, it has been found that there is a practical limit in the cross-sectional relationship between the die cavity and the part as received by the fingered and slotted dies of the present invention and beyond which misshaping and/or pinching is likely to occur. For example, in the case of round tubular stock from which hydroformed parts are generally made, it was found that that portion(s) of the die cavity where mechanical forming is to take place should have a width dimension not less than about 0.8 times the initial outer diameter of the part as pinching was not found to occur at this and greater values but was found to occur at lesser values and with the likelihood of pinching progressively increasing with progressively lesser values below about 0.8.

It is therefore an object of the present invention to provide new and improved hydroforming dies.

Another object is to provide a hydroforming die set wherein the dies self-align and prevent pinching of a part as the dies close on the part.

Another object is to provide a hydroforming die set wherein the dies self-align, prevent pinching of a part as the dies close on the part, and are adaptable to bend, straighten and/or reshape the cross-section of the part during die closure.

These and other objects, advantages and features of the present invention will become more apparent from the following detailed description of an exemplary embodiment shown in the accompanying drawings.

DESCRIPTION OF EXEMPLARY EMBODIMENTS

Figure 1:
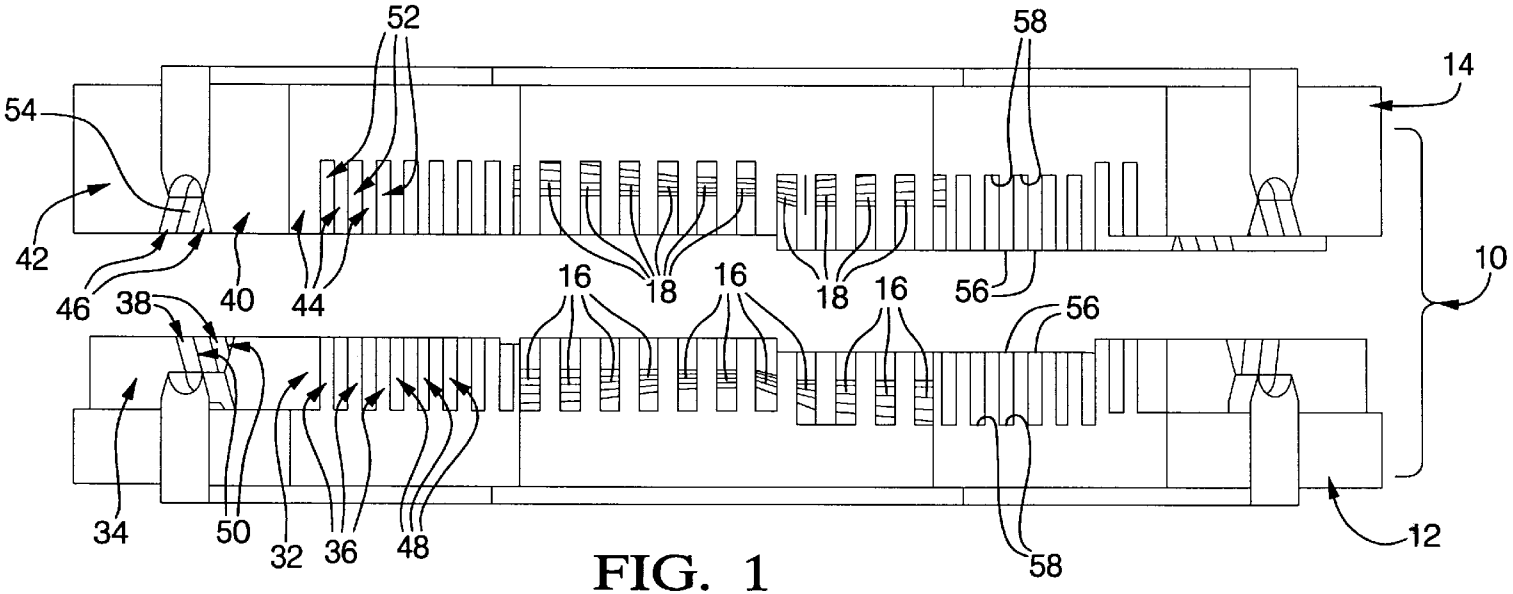
FIG. 1 is a side view of self-aligning non-pinching hydroforming dies according to the present invention wherein the dies are shown open.
Figure 2:
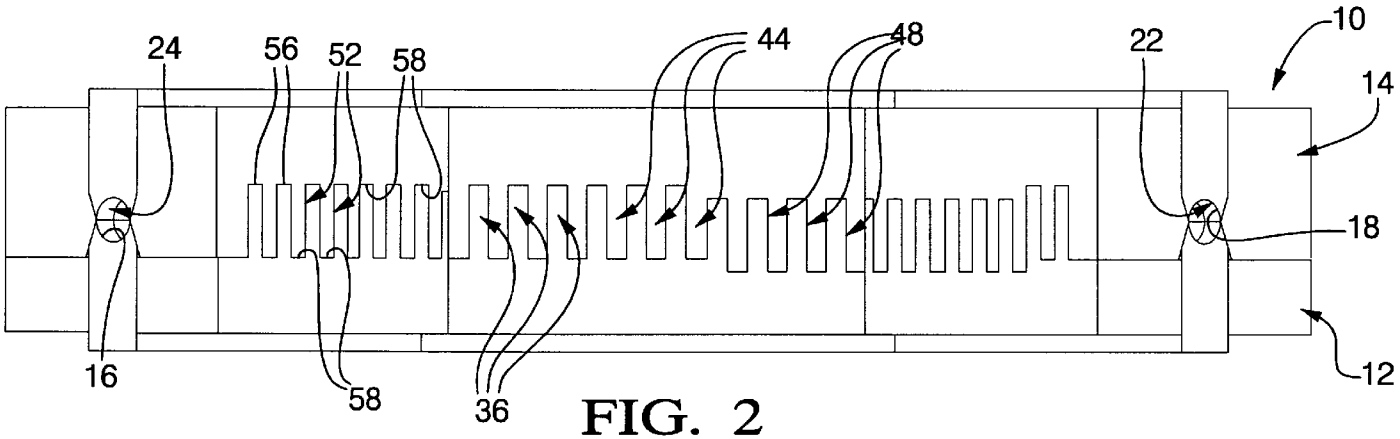
FIG. 2 is a view like FIG. 1 but showing the dies closed.
Figure 3:
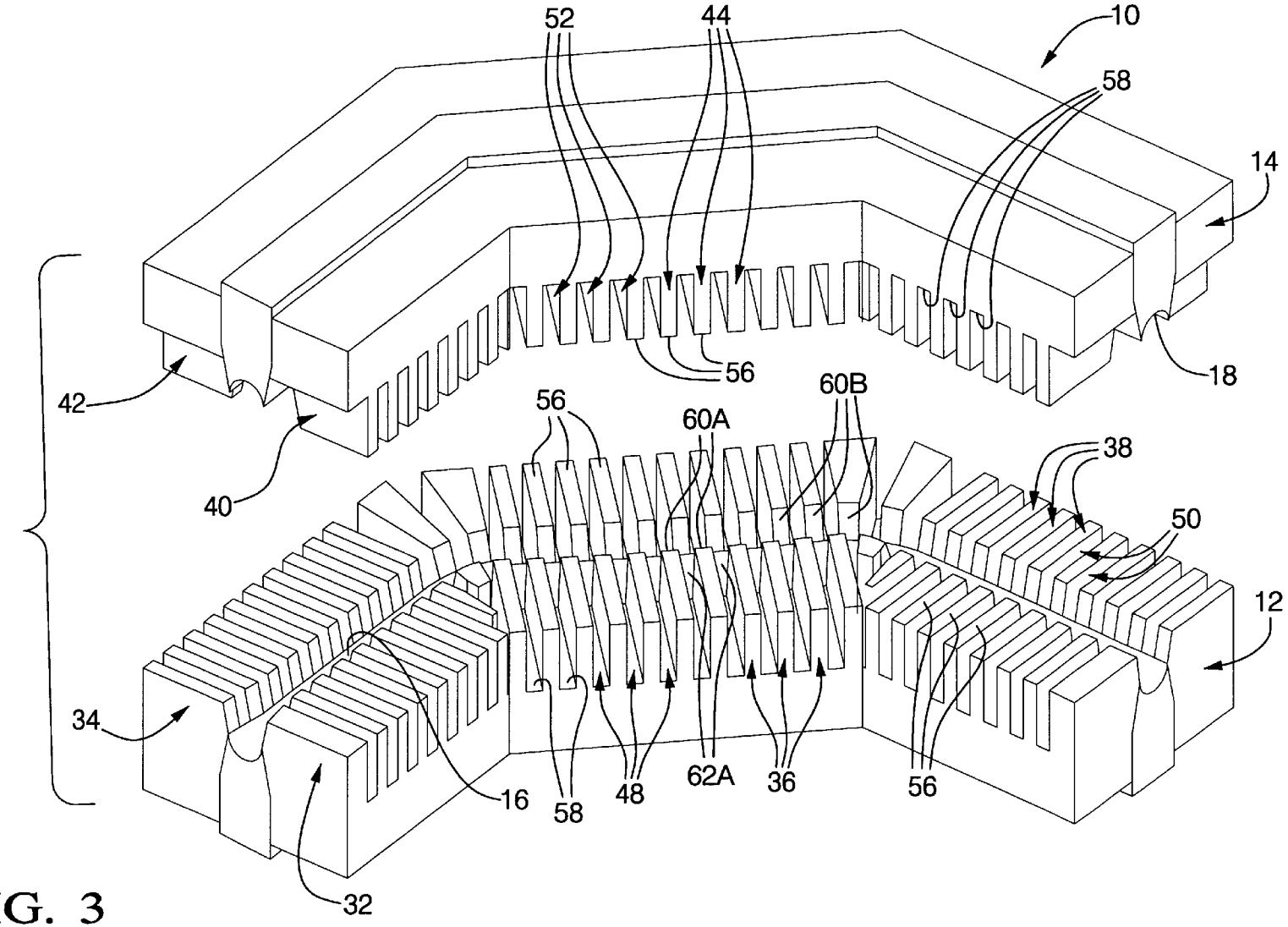
FIG. 3 is an isometric exploded view of the dies in FIG. 1.

Referring to FIGS. 1 and 2 of the drawings, there is shown a hydroforming die set generally designated as 10 comprising a lower die 12 and an upper die 14 adaptable to being mounted in a conventional form of hydroforming apparatus such as disclosed in the earlier mentioned U.S. Pat. Nos. 5,233,854 and 5,233,856. For example, the dies may be fastened in such apparatus by bolts received in vertical holes in the dies wherein the bolt heads are received in counterbored end portions of these holes at the inner side of the dies. And wherein it will also be understood that the dies are operated by such apparatus in a conventional manner so as to open to receive a part, then close on the part for its hydroforming, and then open again for removal of the formed part.

The inner side of the dies 12 and 14 have centrally located die cavity surfaces 16 and 18 extending the length of the respective dies and cooperatively form a die cavity 20 (see FIGS. 2, 5 and 8) when the dies are pressed together at mating surfaces as described in detail later. The die cavity 20 thus formed has cylindrical openings 22 and 24 at opposite ends thereof that are sized at their inner end 22A and 24A, respectively, to tightly receive the respective ends of a tubular metal part 26 to be formed (see FIG. 5). The part 26 being shown in FIG. 4 as it appears prior to being received by the dies and being shown in FIG. 5 in the dies after it has been both mechanically formed by the dies and hydroformed in the die cavity 20.

Figure 5:
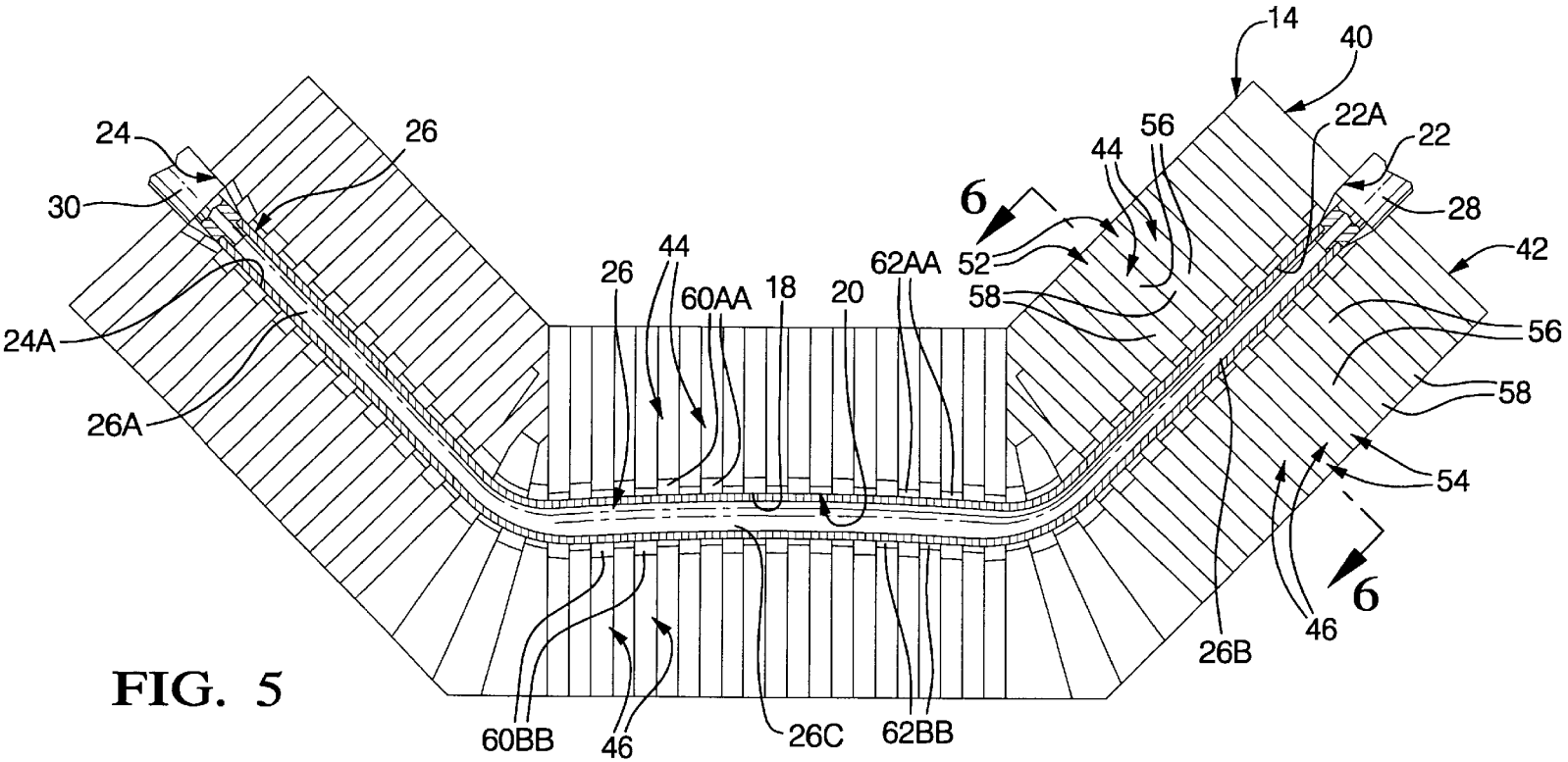
FIG. 5 is a plan view of the inner side of the upper die in FIG. 1.

For the hydroforming of the part, hydroforming fluid delivery/exhausting devices 28 and 30 which are commonly referred to as "seal units" are received in the respective die cavity openings 22 and 24 and are caused to sealingly engage the respective ends of the die enclosed part as shown in FIG. 5. With the seal units 28 and 30 being the means by which hydroforming fluid such as a high water based liquid solution is supplied under pressure to the interior of the part simultaneously through both ends of the part to hydroform the part to the shape of the die cavity surface. With the seal units 28 and 30 also serving as the means by which the hydroforming fluid is exhausted from the part following the hydroforming action. The seal units may for example be like either of those disclosed in the above-mentioned U.S. Pat. Nos. 5,233,854 and 5,233,856 or of any other suitable type.

The versatility of the invention is illustrated by the complex shape to which the exemplary part 26 must be formed wherein a center section of the part must take an expanded shape as well as be bent along its length while end sections of the part must take a generally rectangular cross-sectional shape as well as be bent at 45-degree angles relative to the center section and with one end section further bent at an angle to the plane of its 45-degree angle bend. Given these diverse structural shaping requirements in order form the required shape of the finished part, the part 26 originates as a cutting from a length of tubular metal stock that is typical of the type of stock used to produce hydroformed parts.

Figure 4:
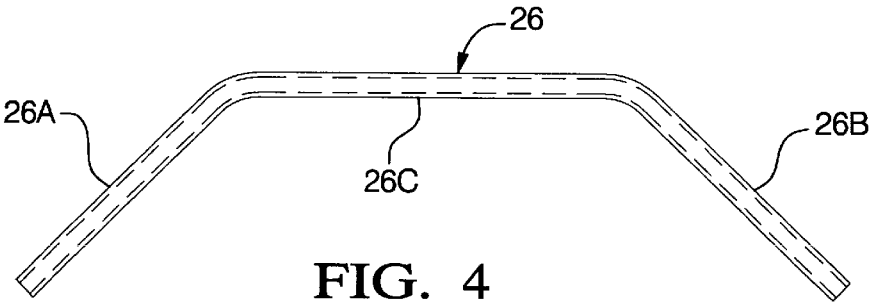
FIG. 4 is a plan view of a tubular part prior to being received in the dies in FIG. 1.

In practicing the present invention and because of the particular final shape of the part required, the cut piece is initially mechanically bent so as to have two 45-degree bends with straight end sections 26A, 26B of the desired length and an intermediate or central straight section 26C of the desired length between the bends. With such bending resulting in the shape of the part 26 as shown in FIG. 4. Such simple bending can, for example, be accomplished with a conventional tube-bending machine such as an NC tube bender. And does not require costly one-of-a-kind preforming dies that would normally be required in order for the part to be received in the rectangular cross-section regions of the die cavity necessary to form the required cross-sectional shape in the bent end sections of the part. Nor does the part need to be prefilled as will become apparent.

Moreover, it will be appreciated that with the part 26 as thus initially bent, one or more of the sections 26A, 26B and 26C of the part may not be straight and is instead bent to some significant degree either because the tubular stock was not initially straight, there was improper handling of the part, there occurred undesired bending of the part from making the mechanical bends described above or for some other possible reason prior to the part being inserted in the hydroforming dies. As will be seen, the dies according to the present invention are adapted to readily accommodate such variances and also provide substantial mechanical forming as well as provide for hydroforming of the part all without allowing pinching of the part between the dies and without having to resort to preforming and/or prefilling the part in order to avoid pinching of the part in the dies as they mate.

To these ends, the dies 12 and 14 are formed with means providing for precise self-aligning of the dies 12 and 14 and also mechanically forming a part such as the prebent part 26 during closure of the dies. Such means comprising (1) two staggered rows 32 and 34 of fingers 36 and 38, respectively, on the inner side of the lower die 12 wherein these rows extend along the opposite sides of the die cavity forming surface 16 and all these fingers extend transverse thereto, (2) two staggered rows 40 and 42 of fingers 44 and 46, respectively, on the inner side of the upper die 14 wherein these rows extend along the opposite sides of the die cavity forming surface 18 and all these fingers extend transverse thereto, (3) slots 48 and 50 in the inner side of the lower die 12 located between and adjoining the respective fingers 36 and 38 and thus also arranged in these rows of fingers, and (4) slots 52 and 54 in the inner side of the upper die 14 located between and adjoining the respective fingers 44 and 46 and thus also arranged in these rows of fingers.

On the lower die 12, the fingers 36 in row 32 are staggered with respect to the fingers 38 in row 34 and thus also the slots 48 with respect to slots 50. And the fingers 36 and 38 have various sizes as shown so as to be closely received in and guided by the respective slots 52 and 54 in the upper die 14 to provide self-alignment of the dies 12 and 14 as they are brought together. The respective fingers 44,46 and slots 52,54 in rows 40,42 on the inner side of the upper die 14 are staggered in relation to each other in the same manner as those on the lower die 12. And also in a like manner, the fingers 44 and 46 have various sizes as shown so as to be closely received in and guided by the respective slots 48 and 50 in the lower die 12 to provide self alignment of the dies 12 and 14 as they are brought together. In addition, all the slots are configured as shown so as to complement the side profile of the respective fingers that they receive. And all the fingers on both dies have flat horizontal edge surfaces 56 and all the slots on both dies have flat horizontal bottom surfaces 58 which form the mating surfaces of the dies when the dies are pressed together.

In addition, the fingers 36 and 38 on the lower die 12 have a flat part engaging edge surface 60A and 60B, respectively, angled toward and terminating at the respective die cavity forming surfaces 16. And in a like manner, the fingers 44 and 46 on the upper die 14 have a flat part engaging edge surface 60AA and 60BB, respectively, angled toward and terminating at the respective die cavity forming surface 18. See FIGS. 3 and 5–8.

Moreover, the slots 48 and 50 in the lower die 12 have an angled flat surface 62A and 62B, respectively, angled toward and terminating at the respective die cavity forming surface 16 like the finger edge surfaces 60A and 60B, respectively, on the lower die. And in a like manner, the slots 52 and 54 in the upper die 14 have an angled flat surface 62AA and 62BB, respectively, angled toward and terminating at the respective die cavity forming surface 18, like the finger edge surfaces 60AA and 60BB, respectively, on the upper die. The angled flat slot surfaces 62A, 62B and 62AA, 62BB have the same the same angle as the respective angled flat edge surfaces 60A, 60B and 60AA, 60BB on the fingers on the opposite die and the oppositely facing angled finger edge surfaces gradually smoothly engage opposite sides of the part (see FIG. 6) and eventually are brought into engagement with the respective slot surfaces 62A, 62B and 62AA, 62BB as the dies come together and mate at the mating surfaces 56 and 58 of the fingers and slots (see FIG. 8). With the dies finally mated at their mating surfaces, the die cavity 20 is entirely defined about the part by the die cavity surfaces 16 and 18 and not by the die finger edge surfaces 60A and 60B nor is the die cavity open to any of the die slots.

The angled edge surfaces 60A and 60B on the fingers in the rows 32 and 34 on the lower die 12 face oppositely and form an acute angle there-between. And likewise the edge surfaces 60AA and 60BB on the fingers in the rows 40 and 42 on the upper die 14. So that as the dies are pressed together about a tubular part positioned between the dies, these edge surfaces of the fingers on the dies cooperate to produce a funneling wedging scissoring action on opposite sides of the tubular part (see FIG. 6). Forcing the tubular part toward the die cavity surfaces while smoothly gradually mechanically forming or reshaping the tubular part as need be to sufficiently conform to the die cavity surfaces to prevent pinching of the part between the mating die surfaces during die closure (see FIGS. 7 and 8). Moreover, this mechanical forming action can also be used to help form a round tubular section to a required non-circular cross-sectional shape and also to further bend the part as will be described below in the adaptation of the dies to form the required final shape of the part 26.

It will be recalled that the required final shape of the prebent part 26 following the hydroforming process requires (1) the end sections 26A and 26B to take a generally rectangular shaped cross-section with one of these sections further having a certain additional bend; namely, a further bend in the end section 26B, and (2) the center section 26C to take an expanded cross-section and also a certain bend along its length. These structural forming requirements are readily met by configuring the die cavity surfaces 16 and 18 so as to define the die cavity 20 along its length between the cylindrical die cavity end sections 22A and 24A with the desired cross-sectional shape and bends and configuring the fingers and slots on the dies accordingly with respect to their respective adjoining die cavity surfaces.

Figure 6:
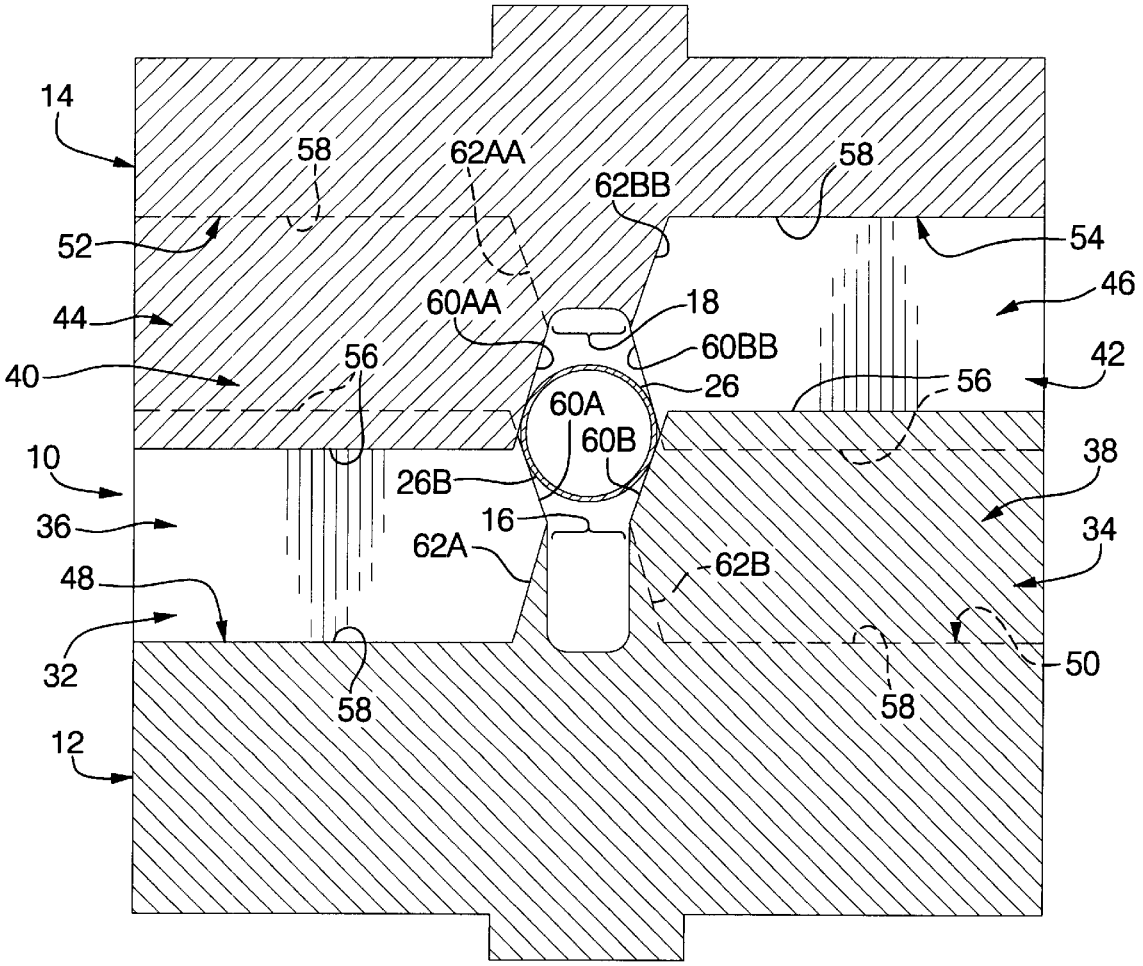
FIG. 6 is a partial enlarged cross-sectional view taken along the line 6—6 in FIG. 5 when looking in the direction of the arrows and includes the corresponding section of the lower die as the dies close on the part shown in FIG. 4.

Describing now the mechanical forming as well as the hydroforming capability of the dies of the present invention as applied to forming the prebent part 26 to the prescribed finished shape with the dies accordingly adapted as described above, the prebent part is placed on and between the fingers 36 and 38 on the lower die 12 while the dies are open. The upper die 14 is then lowered to engage the part between its fingers 44 and 46 and thereafter gradually forced downward toward mating engagement with the lower die 12 at the mating die surfaces 56 and 58 where the die cavity is finally formed about the part. As this occurs, the fingers produce a funneling scissoring wedging action on opposite sides of the part along the length thereof as illustrated in FIG. 6 resulting in straightening, if need be, of the round tubular sections 26A and 26B to conform to the straight end regions of the die surfaces 16 and 18 while bending the round tubular intermediate section 26C to conform with the central curved region of the die surfaces. And thus all without pinching the part as the dies continue to close there about.

As mentioned earlier in the summary of the invention, it has been found that in practicing the invention, there is a practical limit in the cross-sectional relationship between the die cavity and the part as received by the fingered and slotted dies of the present invention and beyond which misshaping and/or pinching of the part is likely to occur. And that in the case of round tubular stock from which hydroformed parts are generally made, it was found that that portion(s) of the die cavity where mechanical forming is to take place such as shown in FIG. 6 should have a width dimension not less than about 0.8 times the initial outer diameter of the part. As pinching was not found to occur at this and greater values but was found to occur at lesser values and with increasing likelihood with progressively lesser values below about 0.8.

Figure 7:
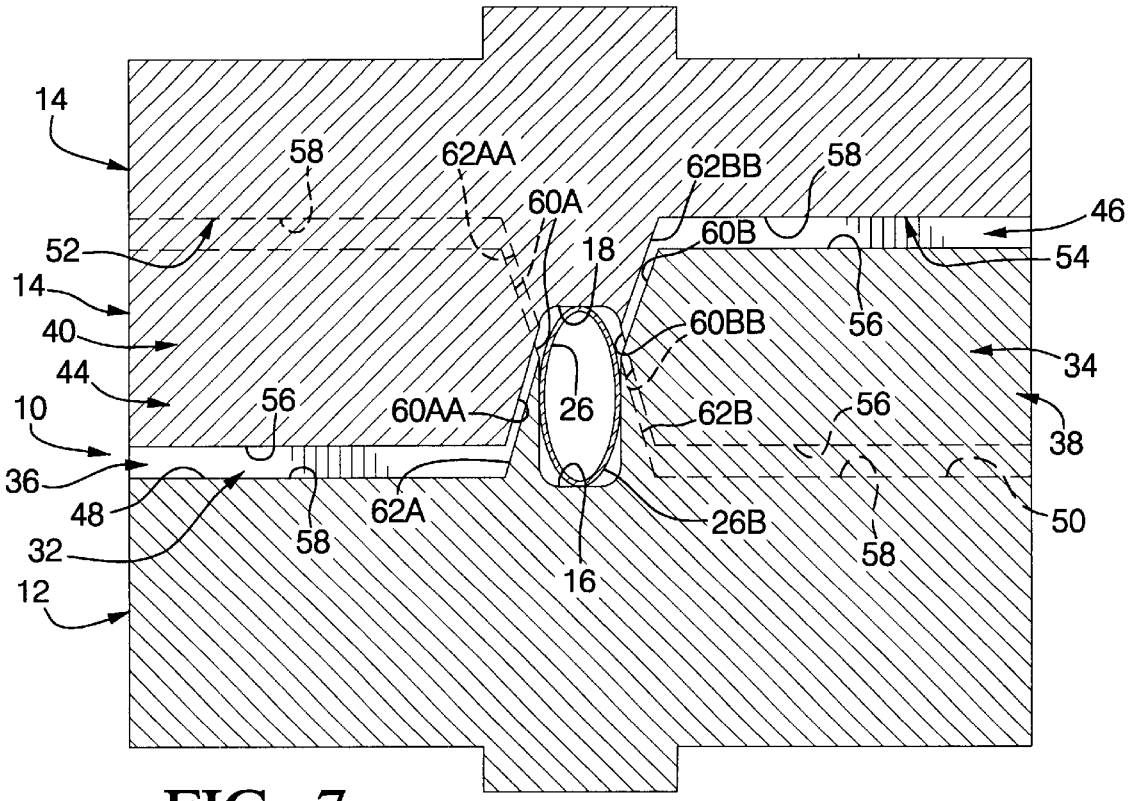
FIG. 7 is a view like FIG. 6 but showing the dies as they continue to close on the part.

Continuing on in the description of the operation of hydroforming dies, during the die closure the die fingers capturing the end sections 26A and 26B of the part also force these sections to yield and gradually form toward the shape of the rectangular cross-sectional regions of the die cavity forming surfaces 16 and 18 as illustrated in FIG. 7. While also forcing the additional required bend in end section 26B of the part which is in a downward direction as viewed in FIG. 2 and wherein it is seen in this view and FIGS. 1–3, that the fingers and slots and adjoining regions of the die cavity forming surfaces are accordingly at lower elevations than those fingers and slots and adjoining die cavity forming surfaces operating on the other end section 26A of the part.

With the mating of the dies, the end sections 26A and 26B of the part are significantly mechanically reshaped to substantially conform to the required rectangular cross-sectional shape and with the required additional bend in section 26B while the intermediate section 26C of the part has been mechanically bent to fit the respective portion of the die cavity and is now ready to be hydroformed to final shape. And with all these operations performed in the hydroforming dies while preventing pinching of the part between the mating surfaces of the dies.

Figure 8:
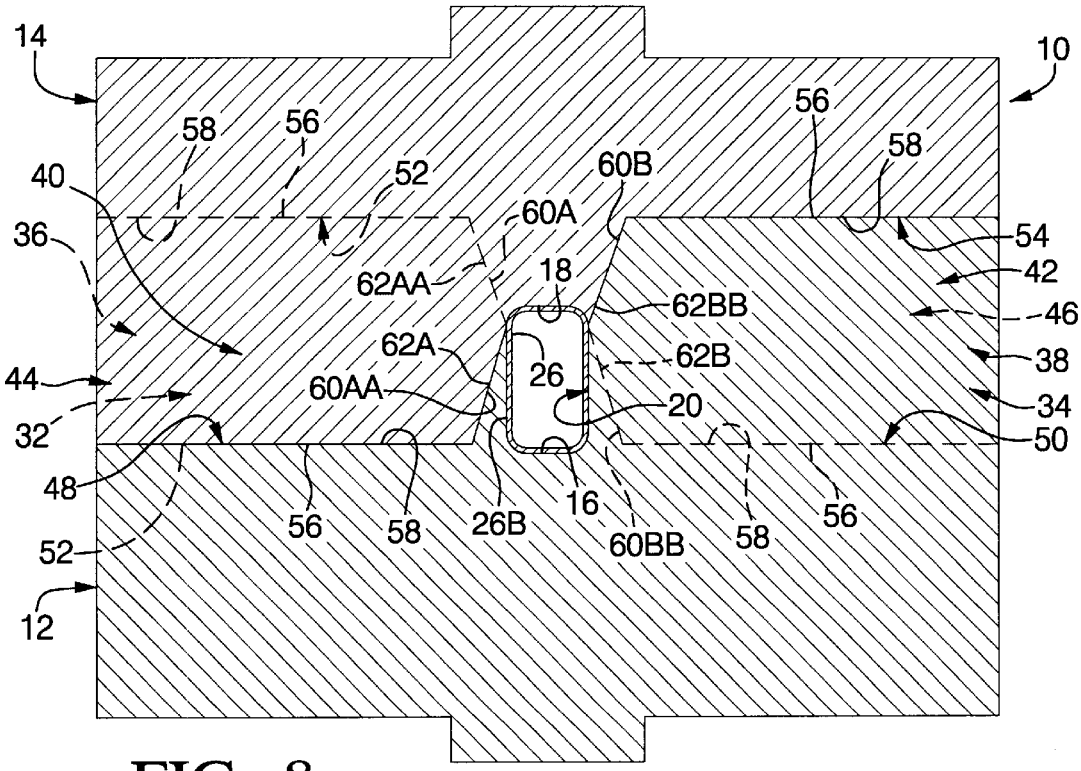
FIG. 8 is a view like FIGS. 6 and 7 but showing the dies as they finally close on the part.

Following the closure of the dies and the accompanying mechanical forming of the part, the seal units 28 and 30 are then engaged with the open ends of the part as seen in FIG. 5 and hydroforming fluid under high pressure is supplied to the interior of the part to hydroform the central section 26C of the part outward to conform to the relatively large cross-sectional region of the die cavity while also hydroforming the end sections 26A and 26B outward as need be in the end regions of the die cavity thereby ensuring that these sections are fully formed to the required rectangular cross-sectional shape as shown in FIG. 8. With the part thus fully formed to the die cavity 20, the hydroforming fluid is then exhausted, the seal units are disengaged, and the dies are opened to permit removal of the finished part.

It will be understood by those skilled in this art, that the part selected to illustrate certain of the advantages and the hydroforming die versatility offered by the present invention is just one example of the many parts that can be both mechanically and hydraulically formed given the self-aligning non-pinching hydroforming die teachings of the present invention. And it will thus be appreciated that the above disclosure is intended to teach as well as disclose the present invention to those skilled in this art and to whom various modifications are likely to become apparent in the practice thereof without departing from the scope of the invention. And it is therefore intended that the scope of the present invention is to be limited only by the scope of the appended claims.

What is claimed is:

1. A pair of hydroforming dies having opposed mating surfaces and opposed die cavity forming surfaces surrounded by the respective mating surfaces, said die cavity forming surfaces forming a hydroforming die cavity when said dies are pressed together at said mating surfaces, each of said dies having alternately arranged fingers and slots wherein the fingers on one of said dies are adapted to be closely received in and guided by the slots in the other of said dies to thereby precisely guide said dies into alignment as said dies are brought together, the fingers and slots on each said die located on opposite sides of the die cavity forming surface on the respective die and being spaced along and extending transversely to and joining with peripheral portions of the die cavity forming surface on the respective die, said fingers and slots on each said die on one of said opposite sides being staggered with respect to the fingers and slots on the other of said opposite sides, said fingers on each said die where they extend to the die cavity forming surface on the respective die having an angled edge surface, and the edge surfaces of the fingers on the opposite sides of the die cavity surfaces on the respective dies forming acute angles there between so that as said dies are brought together about a tubular part positioned between the edge surfaces of the fingers on the respective dies the finger edge surfaces on the respective dies cooperate to produce a funneling wedging scissoring action on opposite sides of the part forcing the part toward the respective die cavity surfaces while gradually mechanically conforming the part as need be to the die cavity surfaces to prevent pinching of the part between said mating surfaces when the dies are pressed together.

2. A pair of hydroforming dies as set forth in claim 1 wherein the tubular part is a round tubular part, and said die cavity has width dimensions not less than about 0.8 times the outer diameter of the tubular part.

3. A pair of hydroforming dies as set forth in claim 1 wherein said die cavity has a longitudinal section with a significant bend, and the edge surfaces of the fingers adjoining said die cavity section are configured to gradually mechanically bend the tubular part to fit within said die cavity section without pinching as the dies are pressed together.

4. A pair of hydroforming dies as set forth in claim 2 wherein said die cavity has a longitudinal section with a non-round cross-section, and the edge surfaces of the fingers adjoining the non-round die cavity section are configured to gradually mechanically form the tubular part toward the die cavity forming surfaces forming the non-round die cavity section as the dies are pressed together.

5. A pair of hydroforming dies as set forth in claim 1 wherein said fingers and slots have flat surfaces forming said mating surfaces.

6. A pair of hydroforming dies as set forth in claim 1 wherein the edge surfaces of said fingers are flat surfaces.

* * * * *